US005971818A

United States Patent [19]

Juntwait et al.

[11] Patent Number: 5,971,818

[45] Date of Patent: Oct. 26, 1999

[54] FINE PITCH DISCRETE WIRE CABLE CONNECTOR

[75] Inventors: Eric D. Juntwait, Irvine, Calif.; Jeffrey Howland; Charles Ray Murphy, both of Inman, S.C.

[73] Assignee: Thomas & Betts Corporation, Memphis, Tenn.

[21] Appl. No.: 08/104,461

[22] Filed: Aug. 9, 1993

[51] Int. Cl.[6] ..... H01R 4/18

[52] U.S. Cl. ..... 439/866

[58] Field of Search ..... 439/595, 865–868, 439/692–697

[56] References Cited

U.S. PATENT DOCUMENTS

| | | | |
|---|---|---|---|
| 2,813,257 | 11/1957 | Cornell . | |
| 2,942,231 | 6/1960 | Cornell . | |
| 3,155,449 | 11/1964 | Henschen . | |
| 3,315,220 | 4/1967 | Flanagan . | |
| 3,707,933 | 1/1973 | Berg | 72/341 |
| 3,941,444 | 3/1976 | Bruni et al. | 439/595 |
| 4,329,009 | 5/1982 | Bungo . | |
| 4,373,773 | 2/1983 | Piscitelli et al. | 439/879 |
| 4,537,463 | 8/1985 | Coiner et al. . | |
| 4,723,925 | 2/1988 | Orr, Jr. et al. | 439/877 |
| 4,840,578 | 6/1989 | Sato . | |
| 4,979,912 | 12/1990 | Shindo et al. | 439/595 |
| 5,186,657 | 2/1993 | Abe | 439/595 |
| 5,207,603 | 5/1993 | Peloza | 439/884 |
| 5,211,583 | 5/1993 | Endo et al. | 439/595 |
| 5,211,589 | 5/1993 | McCardell | 439/879 |
| 5,226,839 | 7/1993 | Koumatsu et al. . | |
| 5,254,021 | 10/1993 | Yamamoto et al. | 439/866 |

FOREIGN PATENT DOCUMENTS

| | | |
|---|---|---|
| 1307683 | 12/1961 | France . |
| 240466 | 10/1986 | Germany . |
| 63-38536 | 10/1988 | Japan . |
| 1-80784 | 5/1989 | Japan . |

*Primary Examiner*—Gary Paumen
*Attorney, Agent, or Firm*—Hoffmann & Baron, LLP

[57] ABSTRACT

An electrical connector comprises an elongate insulative housing having a plurality of cavities extending in side-by-side relation along the longitudinal housing direction. Each of the cavities is nominally spaced for fine pitch applications to be on the order of 0.050 inch. A wire contact assembly which is snapped into the connector housing and resiliently held therein by a releasable latch, comprises an insulation crimping portion that is formed during the crimping process to be of oval configuration. The oval configuration allows the use of wires at least as large as 28 AWG in such fine pitch spacings and permits installation of each wire contact assembly into the connector in the same orientation.

8 Claims, 7 Drawing Sheets

FINE PITCH DISCRETE WIRE CABLE CONNECTOR

FIELD OF THE INVENTION

The present invention relates to an electrical connector and, more particularly, to a fine pitch, discrete wire cable connector utilizing crimp technology.

BACKGROUND OF THE INVENTION

Packaging for telecommunications, computers and electronic systems has continued to decrease in overall size while increasing in functionality. This has resulted in an increase in the density of input/output (I/O) interconnects, creating a demand for fine pitch (0.050 inch spacings and less) connectors to meet limited space constraints.

A variety of interface standards exist today in an effort to maintain compatibility and uniformity when interconnecting computers to printers, drives, and other peripheral devices. Due to the need for increased signal speeds, controlled impedance, and electrical shielding, and while reducing overall size and weight, a new generation of 0.050 inch pitch connectors are beginning to replace the RS-232 type D subminiature connectors which have traditionally been used in these applications. The Small Computer Systems Interface (SCSI) specification has been developed which controls the electrical characteristics of the connecting cable and outlines the mating face of the interconnects. The contact pin layout is shown in FIG. 1, which is defined by two rows, spaced 0.100 inch apart with a contact pitch of 0.050 inch. In order to maintain this fine pitch, certain connector designs have utilized discrete wire insulation displacement contact (IDC) technology.

IDC technology has been an efficient, cost effective method for mass-termination of cables to connectors for many years. The advantage stems, in part, from the ribbon cable design. Orientation of the cable conductors in a uniform row provides strain relief through support from adjacent conductors, typically yielding good electrical performance. When using IDC technology with discrete wire cable applications, some of these advantages are lost. Conductors must be individually terminated, thus eliminating the inherent strain relief. Unless individual contacts have integral strain relief, excessive wire movement can cause large changes in contact resistance or even result in open circuits caused by a loss of the gas tight IDC termination. It thus becomes difficult in fine pitch applications to include an integral strain relief for IDC type contacts.

Crimping discrete wire conductors to contact terminals has also been a cost effective method for high reliable interconnects for years. This technology is advantageous in providing integral contact strain relief, gas tight termination and low installed cost. Because of these advantages, crimp style contact designs are widely used in a variety of cable applications, generally having contact spacings of 0.090 inch and greater. Providing a crimp contact design on 0.050 pitch which adheres to the layout dimensions shown in FIG. 1, has resulted in design difficulties.

Such design difficulties result from a desire to have a contact crimp geometry which would provide a reliable electrical integrity for a range of wire sizes, while adhering to the tight contact spacing requirements. Contradicting this approach is the need to maintain sufficient wall thicknesses in the electrical connector insulative housing of sufficient size and strength to enable mold processability, dielectric strength and overall mechanical stability.

SUMMARY OF THE INVENTION

It is an object of the present invention to provide an improved electrical connector.

It is a further object of the present invention to provide a fine pitch electrical connector utilizing crimp technology.

In accordance with a preferred form of the present invention, an electrical connector comprises an elongate insulative housing including a front face and a rear face and having a plurality of cavities extending between and opening at each of the front and rear faces of the housing. The cavities extend along a longitudinal direction of the housing, each cavity being insulatively separated by an insulative partition. The housing includes a resiliently releasable latch projecting into each cavity. A wire contact assembly is disposed in plural of the cavities. Each wire contact assembly comprises an insulated wire including a conductor surrounded by a layer of insulation and an electrical contact terminated thereto. Each contact comprises an elongate terminal, a locking portion, a conductor crimping portion and an insulation crimping portion. The terminal projects from the cavity through the front face of the housing. Each locking portion engages a housing latch to releasably hold the wire contact assembly within the respective cavity. The conductor crimping portion engages an exposed portion of the wire conductor, thereby making electrical engagement therewith. The insulation crimping portion engages the layer of insulation of the insulated wire. The insulation crimping portion defines a cross-section wherein its dimension along the longitudinal direction of the housing is less than its dimension along a direction substantially orthogonal to the longitudinal direction of the housing. Each of the wire contact assemblies is positioned within a respective cavity in substantially the same orientation with respect to each other.

DETAILED DESCRIPTION OF THE PREFERRED EMBODIMENT

Figure 1:
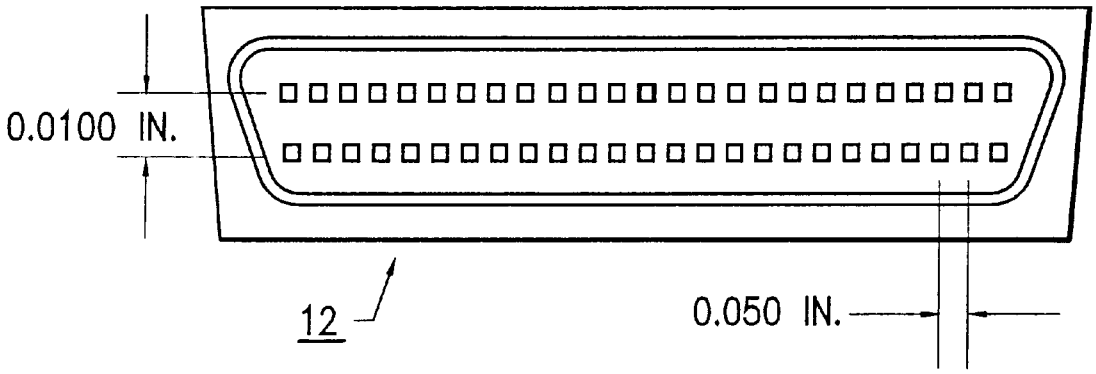
FIG. 1 is a front elevation view of a SCSI 2 connector interface showing the two-row contact pin layout with a contact pitch of 0.050 inch.
Figure 2:
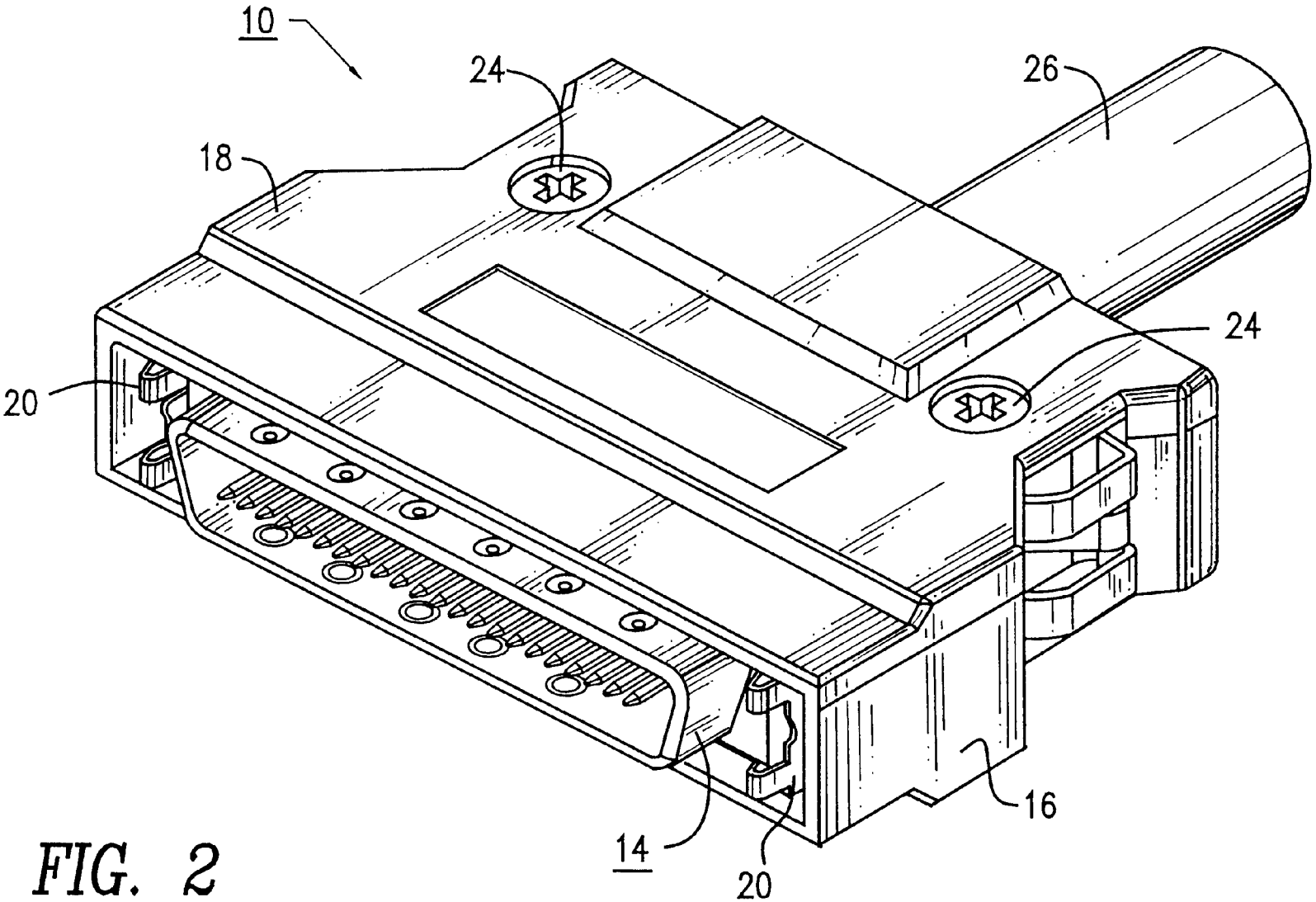
FIG. 2 is a top perspective view of a shielded electrical connector of the retention clip type constructed in accordance with the features of the present invention.

Turning now to the drawing figures, there is shown in FIG. 2 an electrical connector 10 formed in accordance with a particular arrangement of the subject invention. Connector 10 as shown is a 50 position shielded backshell connector with retention clips for mating with a complementary electrical connector. The pin layout of the connector 10 conforms to the pattern 12 as specified in the SCSI 2 connector interface shown in FIG. 1. It should be appreciated that the subject invention may be incorporated in other electrical connectors such as a 68 position jack screw connector version, the pin layout of which is specified in the SCSI 3 specification.

Figure 3:
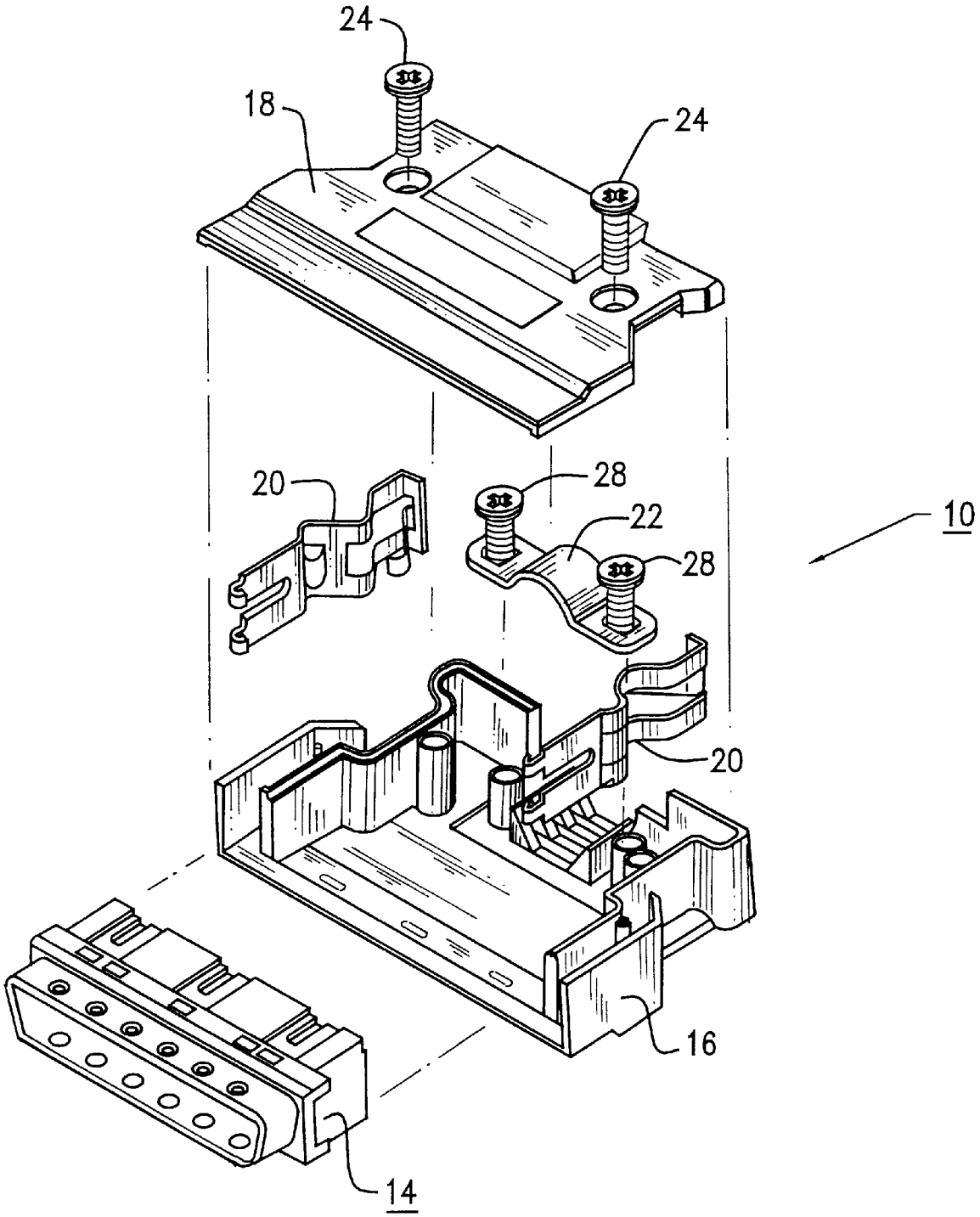
FIG. 3 is an exploded view of the shielded electrical connector of FIG. 2, showing the components thereof, except for the wire contact assemblies.

Turning now also to FIG. 3, the details of the components of electrical connector 10 are illustrated. Electrical connector 10 comprises an insulative housing assembly 14, a backshell base 16, a backshell cover 18, a pair of retention clips 20, and a strain relief strap 22. The backshell base 16 and backshell cover 18 are preferably formed of die cast zinc or metalized plastic, the cover 18 being secured to the base 16 by a pair of threaded screws 24. The strain relief strap which is formed to sandwich the outer insulative jacket of a cable 26 (FIG. 2), comprising a plurality of individually insulated discrete wires which are terminated in the insulative housing assembly 14, is secured to the base 16 by a pair of threaded screws 28.

Figure 4:
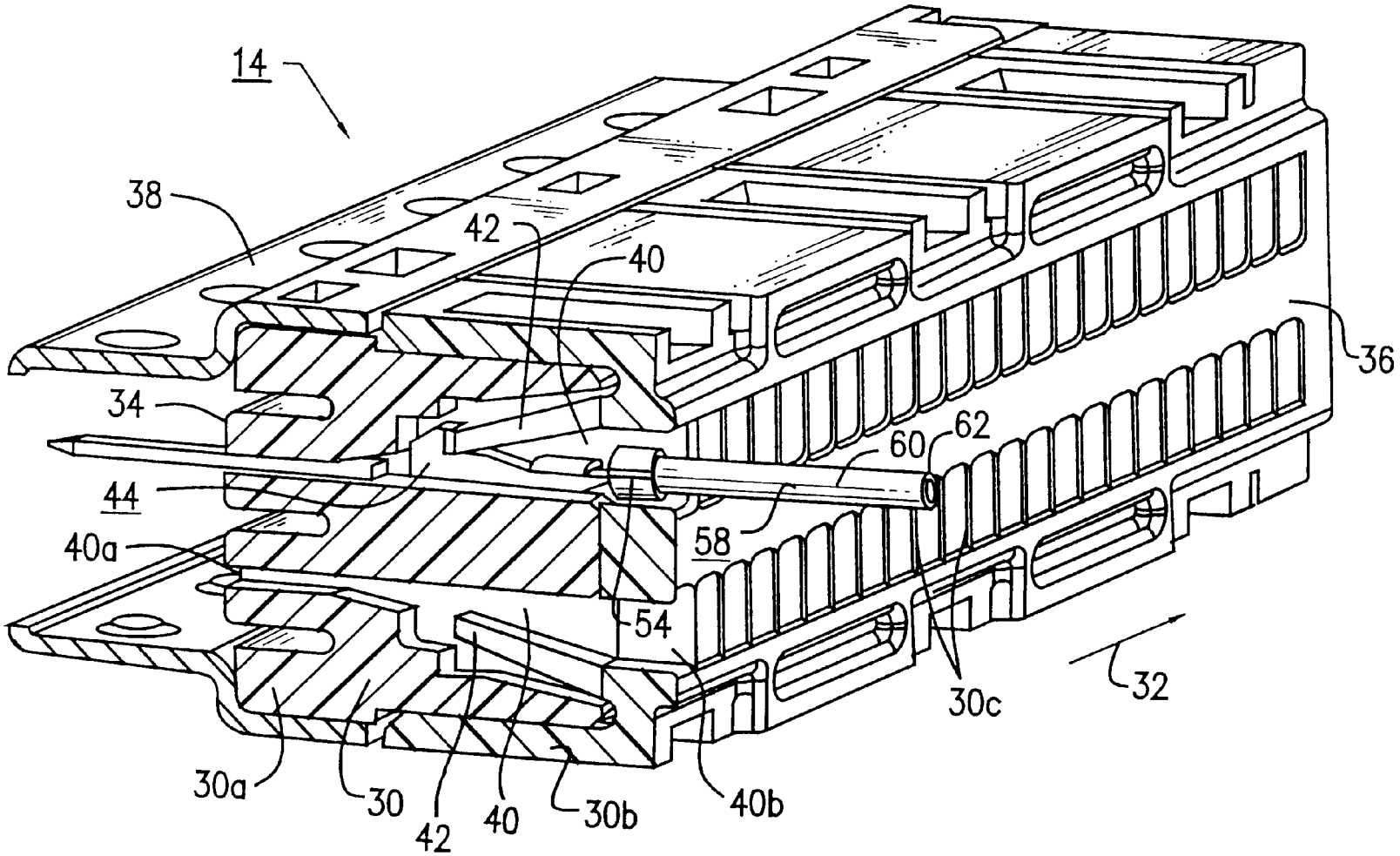
FIG. 4 is a rear perspective view, shown in partial section, of the housing assembly with one wire contact assembly installed therein.

Referring now to FIG. 4, the details of the insulative housing assembly are shown. Housing assembly 14 comprises a housing 30 formed of suitably insulative material, such as polyester, housing 30 being generally elongate along a direction shown by arrow 32 in FIG. 4. Housing 30 defines a front face 34 and a rear face 36. In the preferred arrangement, housing 30 is formed of two components, namely housing base 30*a* and housing base insert 30*b*. The housing base 30*a* is disposed forwardly and defines the front face 34, and the housing base insert 30*b* is disposed rearwardly and defines the rear face 36. Secured on the housing base 30*a* is a metal shell 38 that projects outwardly from and surrounds the front face 34 of the housing 30.

The housing 30 is formed to have a plurality of cavities 40 each extending between the front face 34 and the rear face 36. Each cavity opens at the front face 34 at 40*a* and opens at the rear face 36 at 40*b*.

In the preferred arrangement, there are two rows of cavities 40 provided in the insulative housing assembly 14 forming upper and lower rows of cavities. In each row, the cavities are aligned in side-by-side arrangement extending in the longitudinal direction 32 of the housing 30. Each of the cavities is separated by a housing partition 30*c* thereby individually insulating each of the cavities from each other.

Figure 5:
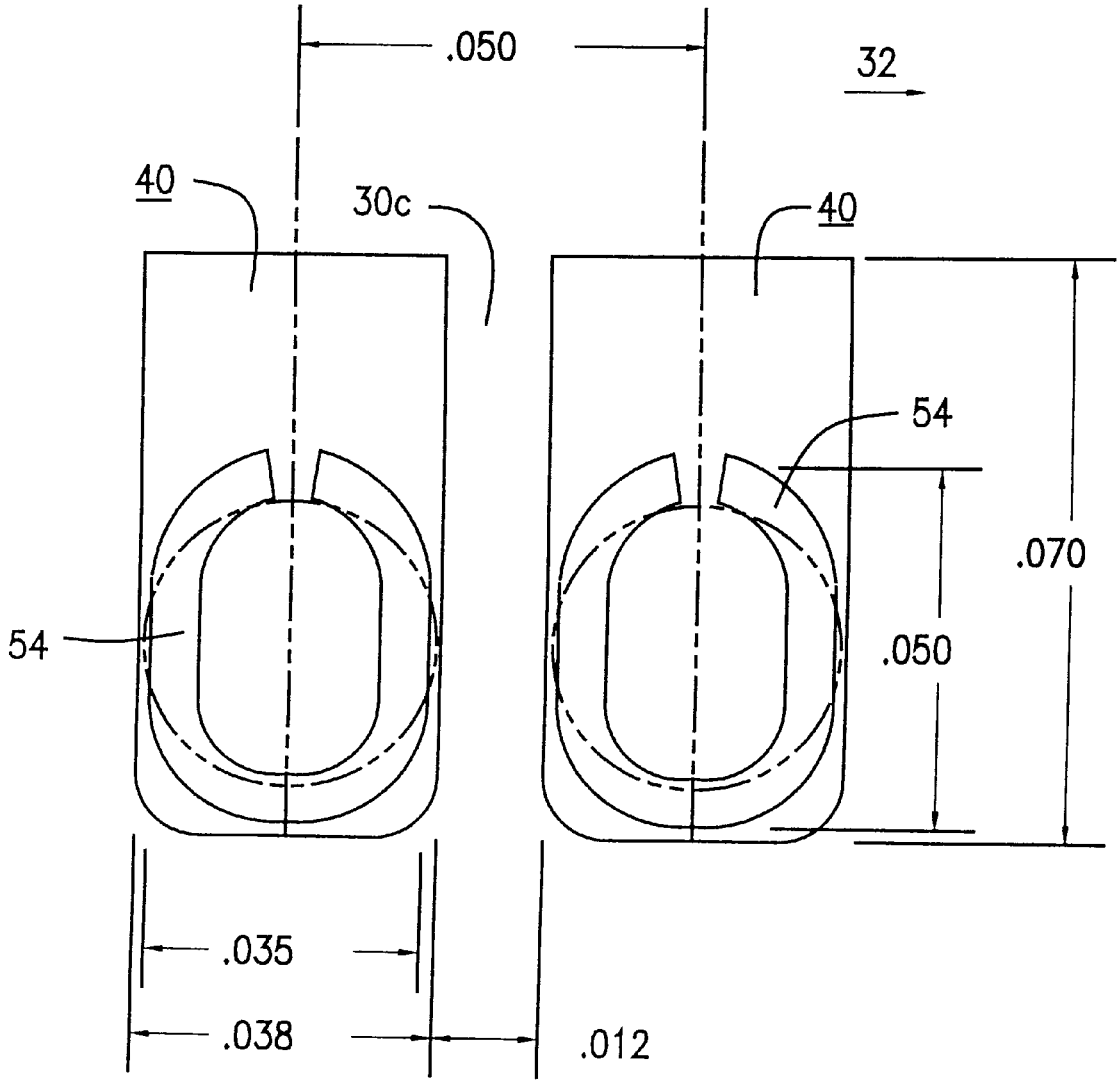
FIG. 5 is a rear enlarged view of the electrical contact insulation crimping portions as they appear after termination to an insulated wire and as disposed within the insulative housing cavities.

As seen in the enlarged view of FIG. 5, each of the cavities 40 is formed generally in rectangular shape with the smaller dimension of such rectangular configurations extending along the longitudinal direction 32 of the housing 30. In the preferred construction, each cavity 40 is formed to have a width of approximately 0.038 inch and a height of 0.070 inch. The centerline spacing along the longitudinal direction 32 between each cavity is 0.050 inch. Thus, the housing partition 30*c* dividing each cavity 40 is approximately 0.012 inch which thickness provides sufficient mechanical strength for mold processability and dielectric strength for adequate insulation between the respective cavities.

Referring again to FIG. 4, the housing 30 is formed to have a resiliently releasable latch 42 projecting into each of the cavities 40. In the preferred arrangement, latch 42 is defined by a resiliently deflectable cantilevered member that is supported by the housing base insert 30*b*. Each latch 42 is configured to deflect in response to the insertion of a wire contact assembly 44 through the rear face 36, as will be described, and to releasably hold the wire contact assembly 44 within the housing. Each latch 42 is accessible by a suitable tool for removing the wire contact assembly 44 through the rear cavity opening 40*b*.

Figure 6:
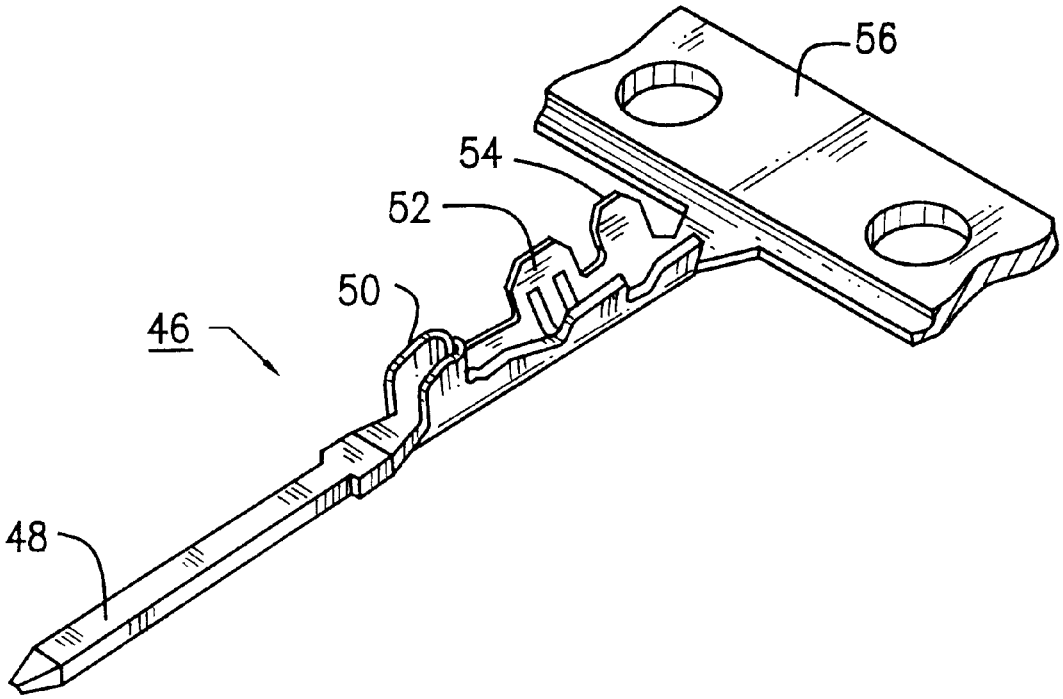
FIG. 6 is a top perspective view of an electrical contact of the present invention shown as still being attached to a carrier strip upon formation thereof.
Figure 7:
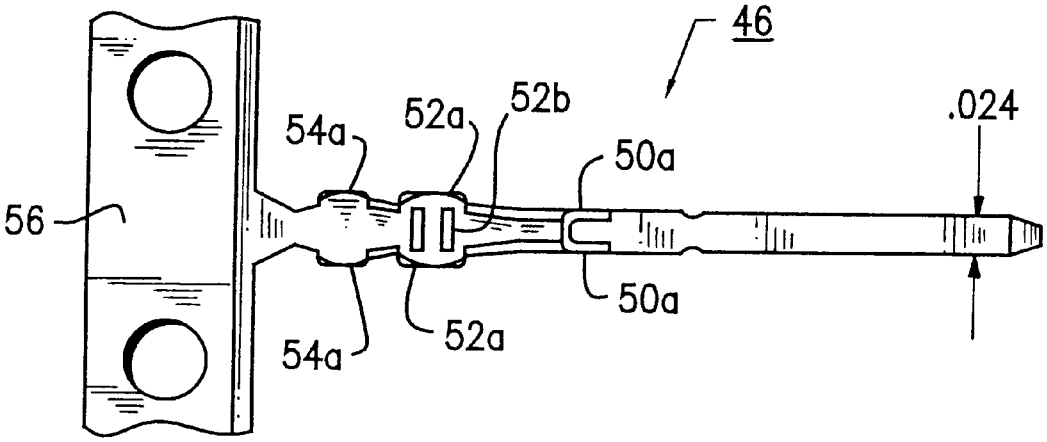
FIG. 7 is a top plan view of the electrical contact of FIG. 6.
Figure 8:
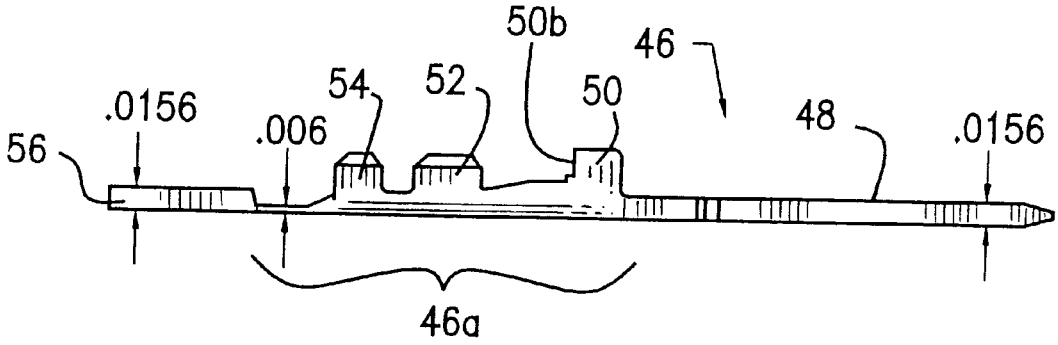
FIG. 8 is a side elevation view of the electrical contact of FIG. 7.

Turning now to FIGS. 6–8, the details of the electrical contact of the subject invention are illustrated. Electrical contact 46 is generally elongate comprising a terminal 48, a locking portion 50, a conductor crimping portion 52 and an insulation crimping portion 54. Although one electrical contact 46 is shown in these drawing figures, it should be appreciated that a plurality of such contacts are formed during manufacturing on a carrier strip 56, the carrier strip 56 being ultimately severed prior to contact use.

In the preferred construction of electrical contact 46, a sheet of uniformly thick metal, such as phosphor bronze, is provided. In the preferred embodiment, the predetermined uniform thickness is selected to be nominally 0.0156 inch. A region 46*a* of the sheet basically encompassing the locking portion 50, the conductor crimping portion 52, and the insulation crimping portion 54 is provided, as shown in FIG. 8, to have a reduced thickness, nominally 0.006 inch. Preferably this reduction is achieved by a milling process. During the manufacture of contact 46, the elongate terminal 48 is formed to have a dimensional width of nominally 0.024 inch as shown in FIG. 7 while the locking portion 50, conductor crimping portion 52, and insulation crimping portion 54 are suitably folded from the reduced sheet thickness region 46*a*. Thus, as formed, the terminal 48 of each contact is of solid, substantially rectangular cross-section defined by a thickness of approximately 0.0156 inch and a width of approximately 0.024 inch, thereby conforming to the SCSI 2 specification. The locking portion 50 is defined by a pair of upwardly extending substantially parallel sidewalls 50*a* defining a rearwardly facing stop shoulder 50*b* for engagement with the housing latch 42 as will be described.

Conductor crimping portion 52 is defined by a pair of upwardly extending, angularly projecting sidewalls 52*a*, there being formed between said walls 52*a* a pair of ribs 52*b* to enhance the engagement to a wire conductor, as will be set forth hereinbelow. Insulation crimping portion 54 is likewise defined by a pair of upwardly extending, angularly extending sidewalls 54*a*.

Turning now again to FIGS. 4 and 5, the assembly of the wire contact assembly 44 and the installation into the insulative housing assembly 14 are depicted. Prior to the assembly of the wire contact assembly 44, a discrete wire 58 is provided. Each wire 58 comprises a layer 60 of insulation surrounding a conductor 62, as shown in FIG. 4. An end of the discrete wire 58 is suitably stripped along a predetermined longitudinal extent thereof by conventional stripping devices and techniques, thereby exposing a portion of the wire conductor 62. It should be appreciated that the contacts 46 are intended to be terminated to electrical wires 58 ranging form sizes 28, 30, and 32 AWG. Such a stripped wire is placed in an electrical contact 46 such that the exposed conductor 62 lies between the sidewalls 52*a* of the conductor crimping portion 52 while the layer 60 of wire insulation lies between the sidewalls 54*a* of the insulation crimping portion 54. By suitable crimping devices, the sidewalls 52*a* and ribs 52*b* are crimped onto the exposed conductor 62, thereby making electrical connection therewith. Similarly, the side walls 54*a* are crimped around the exterior of the layer 60 of wire insulation, making engagement therewith and thereby providing strain relief to the wire 58. In the preferred arrangement, the insulation crimping portion 54 is crimped in the form of an oval, as illustrated in FIG. 5. The dimensions of the oval configuration of the crimped portion 54 are formed such that the longer dimension is approximately 0.050 inch while the shorter dimension in the transverse direction is approximately 0.035 inch. During this crimping process, the wire insulation which, for a 28 AWG wire size is nominally 0.035 inch, is also ovalized. The smaller dimension of the oval configuration during crimping is provided to extend generally in the same direction as the 0.024 inch width of the terminal 48.

The wire contact assembly thus formed is inserted into the insulative housing assembly 14 through the rear face 36. The front openings 40*a* are formed preferably in rectangular shape to receive the terminals 48 such that the width dimension (0.024 inch) extends substantially along the elongate housing direction 32. Upon insertion of the wire contact assembly 44 into and through the cavities 40, the latch 42 projecting into each cavity will snap past the locking portion 50 during insertion and will releasably engage the stop shoulder 50*b* thereby holding the wire contact assembly 44 therein. As installed, the insulation crimping portion 54 of each wire contact assembly 44 is disposed such that the smaller dimension (0.035 inch) of the oval configuration lies substantially along the longitudinal direction 32 of the housing 30. Each of the wire contact assemblies 44 that are inserted into the insulative housing assembly 14 are positioned in the same orientation and in side-by-side disposition without offsetting or staggering the assemblies 44.

Having described the preferred embodiment of the present invention herein, it should be appreciated that variations thereof may be made without departing from the contemplated scope of the invention. For example, while the preferred insulation crimping portion 54 is described herein as being oval, it should be understood that other cross-sectional configurations may be utilized. Such cross-sections would encompass those having a dimension along the longitudinal direction 32 of the housing that is less than a dimension substantially orthogonal thereto. As such, the preferred embodiment described herein is considered illustrative and not limiting. The true scope of the invention is set forth in the claims appended hereto.

I claim:

1. An electrical connector comprising:

an elongate insulative housing including a front face and a rear face having a plurality of cavities extending between an opening at each said front face and said rear face, said cavities extending along a longitudinal direction of said housing, each cavity being insulatively separated by an insulative partition, said housing including a resiliently releasable latch projecting into each cavity; and a wire contact assembly in plural of said cavities, each wire contact assembly comprising an insulated wire including a conductor surrounded by a layer of insulation and an electrical contact terminated thereto, each said contact comprising an elongate terminal, a locking portion, a conductor crimping portion and an insulation crimping portion, said terminal projecting from said cavity through said front face of said housing, each said locking portion engaging a housing latch to releasably hold said wire contact assembly within said cavity, said conductor crimping portion engaging an exposed portion of said wire conductor, thereby making electrical engagement therewith, said insulation crimping portion engaging said layer of insulation of said wire, said insulation crimping portion defining an oval cross-section when crimped wherein its dimension along the longitudinal direction of the housing is less than its dimension along a direction substantially orthogonal to the longitudinal direction of said housing, each of said wire contact assemblies being positioned within the respective cavities in substantially the same orientation with respect to each other.

2. An electrical connector according to claim 1, wherein said wire contact assemblies are insertable into said cavities through said rear face of said housing.

3. An electrical connector according to claim 1, wherein said contact terminal is of rectangular cross-section.

4. An electrical connector according to claim 3, wherein said contact terminal is of solid cross-section.

5. An electrical connector according to claim 4, wherein said terminal has a predetermined thickness and wherein said contact locking portion, conductor crimping portion and insulation crimping portion are all formed along a portion of said contact having a thickness less than said predetermined thickness of said terminal.

6. An electrical connector according to claim 1, wherein a portion of each cavity adjacent each said insulation crimping portion is generally rectangular, with smaller dimension of such rectangular portions extending along the longitudinal direction of said housing.

7. An electrical connector according to claim 6, wherein the centerline spacing between each adjacent cavity is approximately 0.050 inches.

8. An electrical connector according to claim 7, wherein said terminal has a predetermined width of dimension less than the smaller dimension of said oval cross-section.

* * * * *